US006860211B2

(12) United States Patent
Valeriote et al.

(10) Patent No.: US 6,860,211 B2
(45) Date of Patent: Mar. 1, 2005

(54) GUIDE FOR MAKING NON-LINEAR PATTERNS USING A LONG ARM QUILTING MACHINE

(76) Inventors: Michael A. Valeriote, RR 1, Puslinch, Ontario (CA), N0B 2J0; Emiko Kay Valeriote, RR1, Puslinch, Ontario (CA), N0B 2J0

( * ) Notice: Subject to any disclaimer, the term of this patent is extended or adjusted under 35 U.S.C. 154(b) by 61 days.

(21) Appl. No.: 10/400,477

(22) Filed: Mar. 28, 2003

(65) Prior Publication Data

US 2003/0188675 A1 Oct. 9, 2003

Related U.S. Application Data

(60) Provisional application No. 60/369,648, filed on Apr. 4, 2002.

(51) Int. Cl.[7] ..... D05B 11/00
(52) U.S. Cl. ..... 112/117
(58) Field of Search ..... 112/117, 118, 112/119, 102, 103; 33/23.01, 23.02, 23.03, 23.08; 38/102.2

(56) References Cited

U.S. PATENT DOCUMENTS

| | | | | |
|---|---|---|---|---|
| 3,249,077 A | * | 5/1966 | Schwarzberger | 112/118 |
| 3,421,464 A | * | 1/1969 | Cash | 112/118 |
| 3,720,177 A | * | 3/1973 | Taketomi | 112/102 |
| 3,774,558 A | | 11/1973 | Scholl et al. | |
| 4,119,048 A | | 10/1978 | Scholl et al. | |
| 4,134,210 A | | 1/1979 | Scholl et al. | |
| 4,150,489 A | | 4/1979 | Scholl | |
| 4,192,241 A | * | 3/1980 | Reed et al. | 112/117 |
| 4,858,540 A | | 8/1989 | Resta et al. | |
| 5,103,747 A | | 4/1992 | Resta et al. | |
| 5,261,340 A | | 11/1993 | Conley, Jr. et al. | |
| 5,711,236 A | | 1/1998 | Badger | |
| 6,216,617 B1 | * | 4/2001 | Burt, Jr. | 112/103 |

OTHER PUBLICATIONS

Printout from www. Gammill.net website of Mar. 13, 2003, disclosing the "Gammill Design Center" and "Work Station," 3 sheets total.

* cited by examiner

*Primary Examiner*—Ismael Izaguirre
(74) *Attorney, Agent, or Firm*—Richard C. Litman

(57) ABSTRACT

A guide for making non-linear patterns using a long arm quilting machine is used to form a variety of different non-linear stitching patterns in a quilt or other workpiece. The mechanism includes a crossmember which locks adjustably between the fixed tracks of a conventional quilting machine bed or table, and an arm adjustably secured to the crossmember. The arm is slotted to provide both radial and linear adjustment relative to the crossmember. The guide attachment end of the arm provides for the selective attachment of any of a series of different templates thereto. The templates include guide slots or passages therein, with a guide pin or stylus engaging the template slots or passages. The stylus is in turn affixed to the sewing machine, causing the machine to form a stitching pattern according to the specific pattern of the selected template as the stylus travels in the selected slot or passage.

20 Claims, 11 Drawing Sheets

GUIDE FOR MAKING NON-LINEAR PATTERNS USING A LONG ARM QUILTING MACHINE

CROSS-REFERENCE TO RELATED PATENT APPLICATION

This application claims the benefit of U.S. Provisional Patent Application Ser. No. 60/369,648, filed on Apr. 4, 2002.

BACKGROUND OF THE INVENTION

1. Field of the Invention

The present invention relates generally to sewing machines incorporating mechanisms for stitching relatively wide expanses of quilts and similar articles. More particularly, the present invention comprises a series of mechanical attachments for such a long arm type quilting machine, enabling the machine to produce various non-linear stitching patterns in the material being sewn.

2. Description of the Related Art

Mechanized or automated sewing machines for stitching articles having relatively large expanses of fabric have been known for some time. Such machines conventionally have the sewing mechanism positioned at the end of a relatively long arm, to provide a relatively deep throat to allow for the handling of relatively wide expanses of material.

Various mechanisms have been developed for moving the material relative to the sewing head of the machine, or moving the machine relative to the material being stitched. Conventionally, an orthogonal track system is provided, with the material being stitched held stationary during the sewing process, and the machine being moved longitudinally or laterally over the material by means of the orthogonal track system. In some cases, the machine may be translated simultaneously along the two tracks or guides, enabling the machine to produce diagonal and other patterns of stitching.

More recently, electronically guided machines have been developed, in which computerized patterns are used to drive an automated mechanism to produce relatively complex non-linear patterns. However, such machines are relatively costly, with their expense placing them out of the range of the typical hobbyist or home small business.

As a result, there have been some attempts to develop machines capable of producing non-linear stitching patterns, but which use relatively inexpensive mechanisms. The present inventors are aware of some devices which attempt to meet this need, but all of the devices of the prior art known to the present inventors have one or more deficiencies, and/or fail to satisfy all of the requirements of such a machine.

Accordingly, a need will be seen for a guide system for use with long arm quilting machines and the like, which system enables the machine to be used to produce non-linear patterns in a quilt or other wide expanse of material. The present guide system includes a positionally adjustable crossmember which locks in place between the two lateral tracks of the bed of a conventional quilting machine assembly. A slotted arm is secured adjustably to the crossmember, with the arm being adjustable angularly and linearly from its crossmember attachment point. One or more guide components may be removably and adjustably secured to the distal end of the arm, in order to guide the sewing machine as desired. The guide components each include at least one guide slot or rotary hole, in which a stylus or guide pin travels. The guide pin may be raised and lowered to allow the machine and/or guide mechanism to be repositioned as desired, but is otherwise immovably affixed to the sewing machine. The guide pin travels in the slot or rotating hole of the stitching pattern of the selected guide component, thereby causing the machine to translate correspondingly over the bed of the assembly by means of the orthogonal tracks upon which the sewing mechanism travels.

In another embodiment, the guide apparatus comprises a template attachment plate comprising a sheet of material affixed to the bed or table of the machine. The attachment plate includes a matrix of holes therein, as in a sheet of pegboard or the like. A template having a guide slot or channel formed therein is secured to the attachment plate by a series of pegs or pins, with the stylus or guide pin traveling in the template slot or channel to guide the sewing machine.

A discussion of the related art of which the present inventors are aware, and its differences and distinctions from the present invention, is provided below.

U.S. Pat. No. 3,774,558 issued on Nov. 27, 1973 to Hans Scholl et al., titled "Template For Sewing Devices," describes a complex mechanism for use with swing arm mounted sewing machines. The Scholl et al. mechanism comprises a large number of relatively small slotted fingers, which are individually adjusted to define a track along their ends. A roller runs along the track defined by the fingers, thereby guiding the machine during the sewing process. The Scholl et al. mechanism is not adaptable to conventional quilting machines, as used with the present invention, due to the guide mechanism being disposed beneath a fixed support, from which the arms supporting the sewing machine extend. The Scholl et al. mechanism is not adaptable to accept a guide pin extending from the sewing machine, as is the case with conventional quilting machines.

U.S. Pat. No. 4,119,048 issued on Oct. 10, 1978 to Hans Scholl et al., titled "Template Control For Sewing Machines," describes a variation upon the mechanism described in the '558 U.S. patent to the same inventors, discussed immediately above. The mechanism of the '048 U.S. patent is quite similar to that of the '558, U.S. patent with the same points of distinction existing between the device of the '558 U.S. patent and the present invention.

U.S. Pat. No. 4,134,210 issued on Jan. 16, 1979 to Hans Scholl et al., titled "Guide Template For Sewing Machines," describes another mechanism related to those of the '558 and '048 U.S. patents to the same inventors, discussed above. The mechanism of the '210 differs primarily in that the roller guides comprise a pair of elongate arms or tracks along which the guide roller moves, rather than a large number of relatively small or narrow fingers, with the ends of the fingers defining the roller guide track. The same points raised in the discussions of the '558 and '048 U.S. patents, are seen to apply here as well.

U.S. Pat. No. 4,150,489 issued on Apr. 24, 199 to Hans Scholl, titled "Adjustable Template For Sewing Device," describes a guide mechanism having a large number of guide fingers to define the track, as in the U.S. Pat. Nos. '558 and '048 U.S. patent discussed further above. The guide fingers of the '489 U.S. patent include a flexible wire which runs laterally through all of the guide fingers, linking them together for ease of assembly and adjustment. Otherwise, the same points of difference raised in the discussions of the '558 and '048 U.S. patent are seen to apply here as well.

U.S. Pat. No. 4,858,540 issued on Aug. 22, 1989 to Rodolfo Resta et al., titled "Quilting Machine With Adjustable-Length Cloth-Holder Cylinder," describes a quilting machine mechanism in which the sewing head moves linearly along the length of the cylinder, while the cylinder rotates beneath the sewing head to provide the orthogonal movement needed to form stitched patterns in a sheet of material. The large cylinder upon which the workpiece is placed precludes placement of the workpiece between the sewing head and guide mechanism, as the guide mechanism would be enclosed within the cylinder holding the workpiece thereon.

U.S. Pat. No. 5,103,747 issued on Apr. 14, 1992 to Mario Resta et al., titled "Quilting Machine With Stationary Cloth-Holder Frame And Sewing Heads Movable In Orthogonal Directions," describes a machine having a stationary workpiece, with one or more movable sewing heads. The mechanism of the Resta et al. '747 U.S. patent comprises a frame or bed, with a pair of opposed stationary upper tracks. A laterally movable pair of upper and lower tracks extends between the stationary tracks, and respectively holds at least one sewing head and a corresponding "hook" or "crochet" head below each sewing head. However, no means is disclosed for guiding the sewing head(s) to form a predetermined stitching pattern.

U.S. Pat. No. 5,261,340 issued on Nov. 16, 1993 to Ralph F. Conley, Jr. et al., titled "Detachable Template Clamp Having A Removable Sewing Template," describes a mechanism which grips and moves the workpiece beneath a stationary sewing machine head. Conley, Jr. et al. do not disclose the apparatus for controlling the movement of the workpiece gripping mechanism and workpiece gripped thereby. The Conley, Jr. et al. apparatus is essentially opposite that of the present invention, in which the workpiece remains stationary during the stitching operation, while the sewing head moves over the stationary workpiece.

U.S. Pat. No. 5,711,236 issued on Jan. 27, 1998 to Hartley B. Badger, titled "Accessory For A Professional Quilting Machine," describes a guide system for a sewing machine movable on orthogonal pairs of tracks. Only two guides are disclosed by Badger: (1) a diagonal arm against which a guide attached to the movable sewing machine rides, and (2) a rotating arm to which the sewing machine guide arm attaches, to cause the sewing machine to form a circular pattern. No other patterns can be formed using the Badger mechanism. The center of the circular pattern is fixed and the diameters of the circles which may be formed are limited, in comparison to the versatility of the present quilting machine guide apparatus.

Finally, although not prior art, the website of the Gammill Quilting Machine Company accessed on Mar. 13, 2003 includes a disclosure of two assemblies for forming non-linear patterns using quilting machines with movable sewing heads. A first such device, called the Design Center, comprises a base which secures between the two fixed lateral tracks of the conventional quilting machine table. The base includes a rotating circular component therein, which in turn has an adjustably positionable center on which a circle guide may be placed. Various cams and gears can be added to the assembly to form non-circular stitching patterns.

The second device is called the Work Station, and also comprises a fixed base which is secured between the two fixed lateral tracks of the table. A circular device is rotatably installed upon the base, with the circular device including a series of oval patterns thereon. The circular device may be indexed to a limited series of positions or orientations upon the base. A zigzag template is also included, which may be affixed to the base.

Both the Design Center and Work Station operate by means of grooves formed in the various templates, in which a guide pin travels. The guide pin is affixed to the sewing machine head, to cause the head to travel in the pattern defined by the selected groove of the template. However, the two Gammill devices do not provide the versatility of the present invention, due to their relatively fixed positions on the fixed base between the two fixed tracks or sides of the table.

With the Gammill system, the quilt material must be tediously aligned to position the sewing machine needle in the exact location desired, as the locations of the templates, and thus the sewing machine, are fixed relative to the base for any given pattern. In contrast, the present invention attaches the various templates to an arm, with the arm being adjustably attached to a crossmember which in turn adjustably locks between the two tracks or sides of the table. This allows the workpiece and machine to be positioned arbitrarily as desired, with the template position being adjusted to match the resulting location of the stylus or guide pin attached to the machine. The positional adjustability of the base, and further adjustability of the various templates and patterns on the adjustable base, provide considerably greater versatility and ease of use for the present invention in comparison to the Gammill and/or other devices of which the present inventors are aware.

None of the above inventions and patents, taken either singly or in combination, is seen to describe the instant invention as claimed. Thus a guide for making non-linear patterns using a long arm quilting machine and solving the aforementioned problems, is desired.

SUMMARY OF THE INVENTION

A guide for making non-linear patterns using a long arm quilting machine, provides for the formation of a large number of different non-linear (e.g., circular, elliptical, etc.) stitching patterns in a quilt or similar large sheet of material. The present invention comprises a crossmember which locks adjustably between the conventional opposed immovable tracks at the forward and rearward edges of the machine bed or table. A slotted arm is adjustably locked to the crossmember, with the slot in the arm allowing the arm to be pivotally and linearly adjusted relative to the crossbar and other components of the machine.

The distal guide attachment end of the crossbar includes means for attaching one or more of several different fixtures and templates thereto. The various fixtures and templates each include some form of slot or hole for engaging the lower end of a stylus or guide pin. The guide pin is in turn secured to the sewing machine. The guide pin travels in a path defined by the template slot or rotary guide hole of the selected template, thereby causing the sewing machine to travel in the same path relative to the article being stitched to form a stitching pattern therein corresponding to the path of the guide pin.

In another embodiment, a relatively large template attachment plate is immovably affixed to the table or bed of the machine assembly. The template attachment plate includes a matrix of holes therein, providing for the removable and adjustable positioning of a template thereon. The template includes one or more slots or grooves therein which define a pattern, with the stylus or guide pin traveling the path defined by the slot(s) or groove(s) to cause the machine to stitch a like pattern(s) in the workpiece.

Accordingly, it is a principal object of the invention to provide a guide for making non-linear patterns using a long arm quilting machine, having a series of positionally adjustable mechanical components which guide the motion of the sewing machine and its needle along a predetermined stitching path as desired.

It is another object of the invention to provide a guide for a quilting machine having a positionally adjustable crossbar which is locked between the opposed sewing machine tracks of the machine bed or table with an adjustably positionable arm extending therefrom, with the distal or guide attachment end of the arm having one or more guides including one or more guide pin slots or holes therein, for guiding a stylus affixed to the sewing machine.

It is a further object of the invention to provide a guide for a quilting machine in which the guide attachment end of the arm is infinitesimally positionable to allow the sewing machine and its needle to be positioned precisely without need to reposition the quilt or other workpiece relative thereto.

An additional object of the invention is to provide a guide for a quilting machine including a relatively large template attachment sheet for immovably affixing to the underlying table or bed surface of the machine assembly, with the sheet including a matrix of holes for adjustably affixing a template thereto.

Still another object of the invention is to provide a guide for a quilting machine having a series of different guides for forming different non-linear stitching patterns in a quilt or other workpiece, as desired.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a series of embodiments of guides for use in forming stitching patterns using a long arm quilting machine. The present stitching guides are a purely mechanical means of interconnecting the movement of the sewing machine head, and thus the sewing needle, with a device which regulates the movement of the machine in accordance with the specific stitching pattern desired and corresponding guide installed with the device. The stitching guide or template selected is attached to a fixture which is immovably affixed to the table or bed upon which the sewing machine is mounted, thereby assuring accurate stitching patterns which may be repeated as desired.

Figure 1:
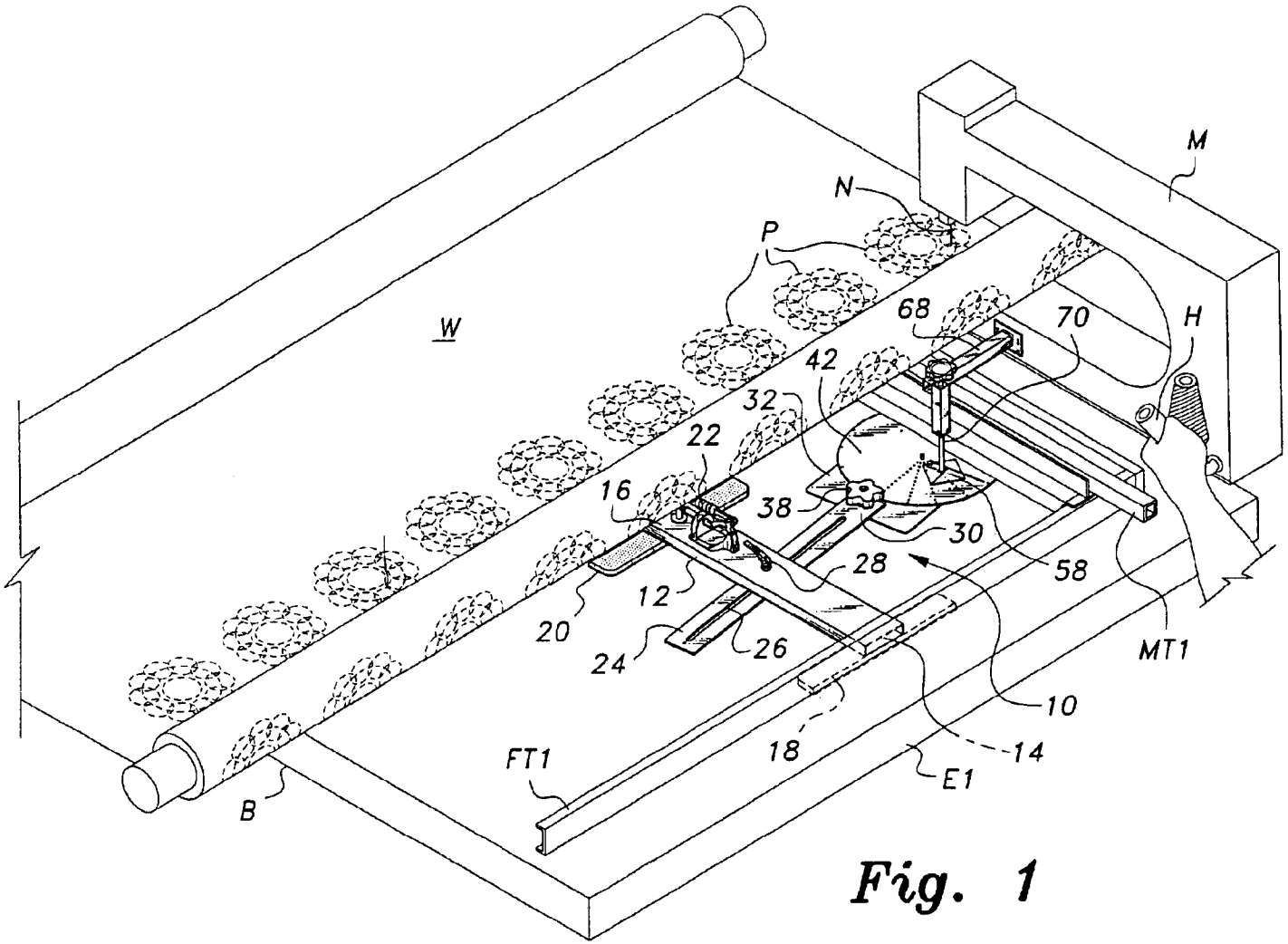
FIG. 1 is an environmental, perspective view of a guide for making non-linear patterns using a long arm quilting machine according to the present invention, showing its general configuration, features, and operation.
Figure 2:
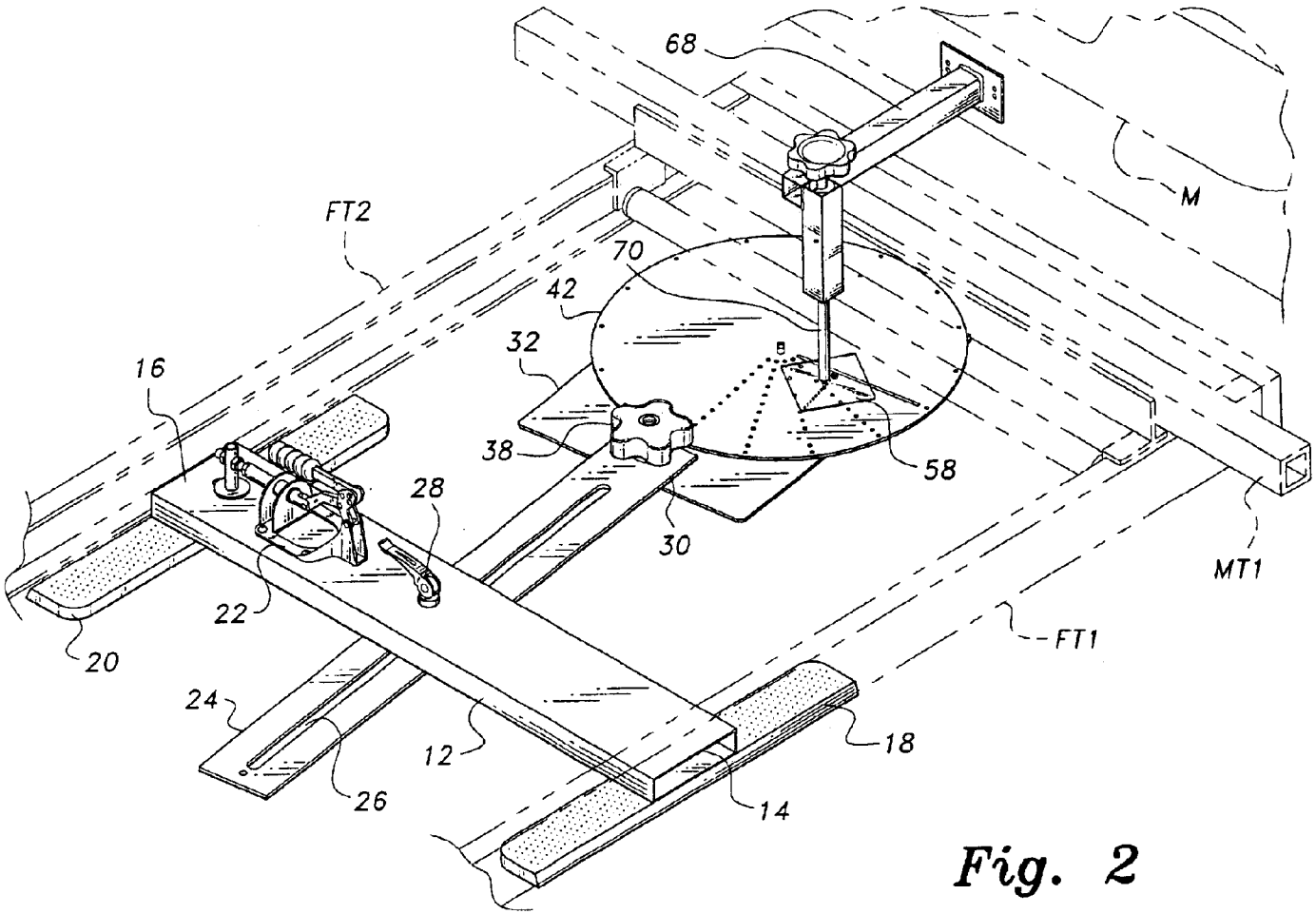
FIG. 2 is a detailed perspective view of the guide assembly of FIG. 1, showing further details thereof.

FIGS. 1 and 2 respectively provide environmental and detailed perspective views of a long arm quilting machine M, its table or bed B (FIG. 1), and the present stitching guide invention 10 installed thereon, in use in forming a series of geometric patterns P upon a workpiece W (e.g., quilt, etc.). Conventionally, such machines M have a relatively long upper arm which defines a relatively deep throat beyond the needle N, providing sufficient room for the typically large expanse of material of the workpiece W to be gathered (rolled, etc.) within the throat of the machine M during stitching operations.

The machine M is movable relative to the table or bed B, with first and second fixed machine bed tracks FT1 and FT2 (the second fixed track FT2 is shown in broken lines in FIG. 2) installed along the opposite, parallel first and second edges (only the first edge E1 is illustrated in the drawing Figs.), as is conventional in the art. Conventionally, a second pair of movable sewing head tracks (only the first movable track MT1 is shown in the drawings) is movably secured orthogonally to the two fixed machine bed tracks FT1 and FT2, with the sewing machine M being movably secured to the movable tracks. Thus, the sewing machine M may be moved to any practicable location in the plane defined by the limits of the two orthogonal track pairs FT1–FT2, and MT1 and the unshown second movable track.

The above discussion describes a conventional long arm quilting machine, as known in the art of mechanized sewing machines used for creating stitching patterns in workpieces comprising large expanses of material. The present invention is a guide 10 which restricts the motion of the machine M to a geometric pattern when the machine M is manipulated by the user by means of the conventional handle(s) H extending therefrom.

Figure 7:
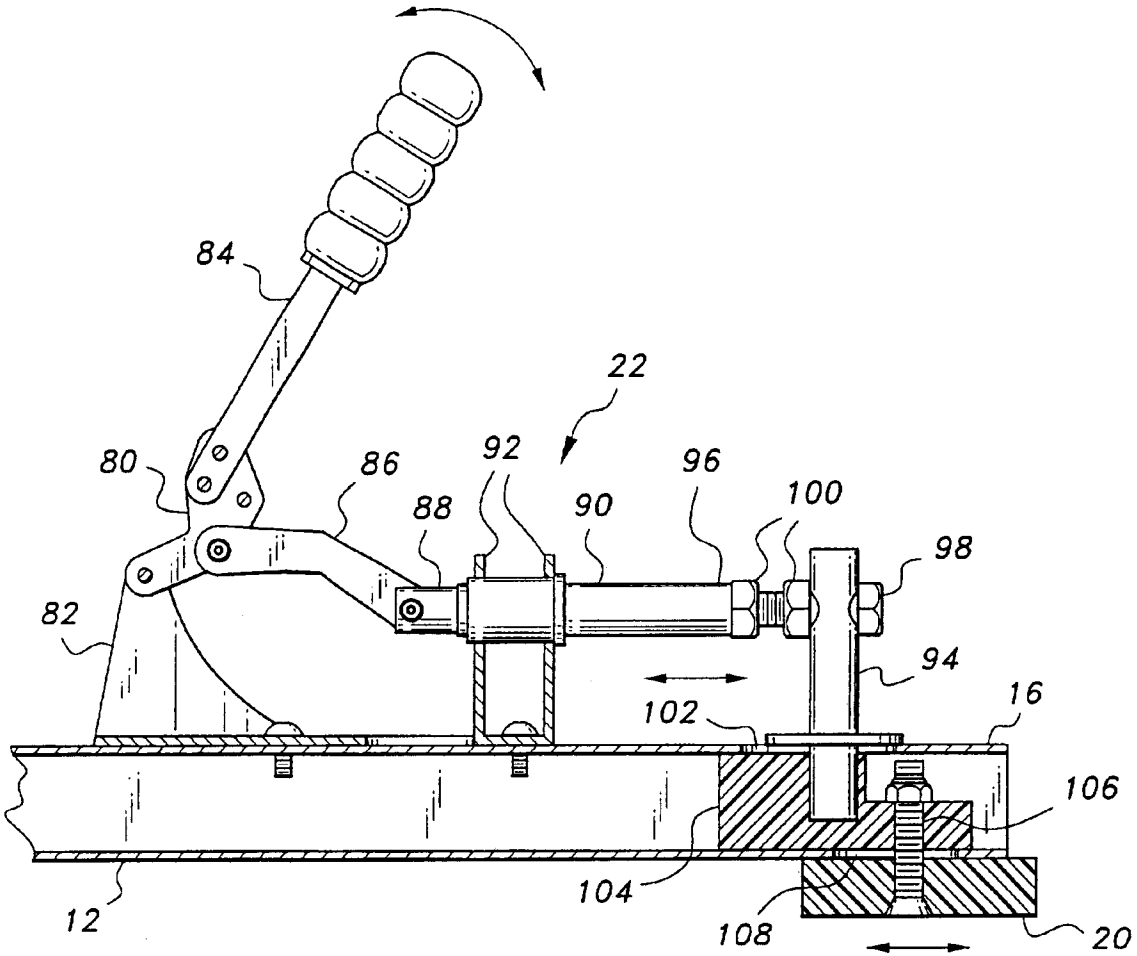
FIG. 7 is a detailed side elevation view in partial section of a first embodiment of the mechanism for locking the crossmember between the two fixed tracks of the machine table.

The present guide 10 includes an elongate crossmember 12, which selectively locks or clamps between the two fixed machine bed tracks FT1 and FT2. The crossmember 12 includes opposite first and second ends, respectively 14 and 16, with each end having a compression shoe or block, respectively 18 and 20, extending laterally therefrom to engage the interior of the respective fixed track FT1 or FT2. (An alternative embodiment comprises a pair of tensile grips which grip the outside of the tracks in some quilting machines, as shown in FIG. 7 and discussed in detail further below.) The first end block 18 is immovably affixed to the first crossmember end 14, while the opposite second end block 20 is adjustably positioned by means of an over center position lock 22. Securing the lock 22 extends the second block 20 against the second fixed track FT2, to lock the crossmember 12 in place between the two tracks FT1 and FT2.

An elongate extension arm 24 is adjustably secured to the crossmember 12, at a generally medial point along the crossmember 12. The extension arm 24 comprises a relatively thin, flat length of material having a longitudinal locking bolt slot 26 formed generally centrally therethrough. A locking bolt (shown in detail in FIG. 9, and discussed in detail further below) passes through the extension arm slot 26, with the extension arm 24 being linearly and radially adjustable along and around the lock bolt and relative to the crossmember 12. An extension arm locking mechanism 28

(shown in detail in FIG. 9, and discussed in detail further below) selectively locks the position of the extension arm 24 relative to the crossmember 12, as desired.

The extension arm 24 includes a template attachment end 30, providing for the adjustable and removable attachment of one of a series of stitching templates or guides thereto. More specifically, a template attachment plate 32 is adjustably secured to the template attachment end 30 of the extension arm 24, with one or more stitching templates (illustrated in FIGS. 4 through 6, and discussed in detail further below) being removably and adjustably secured to the template attachment plate 30.

Figure 3:
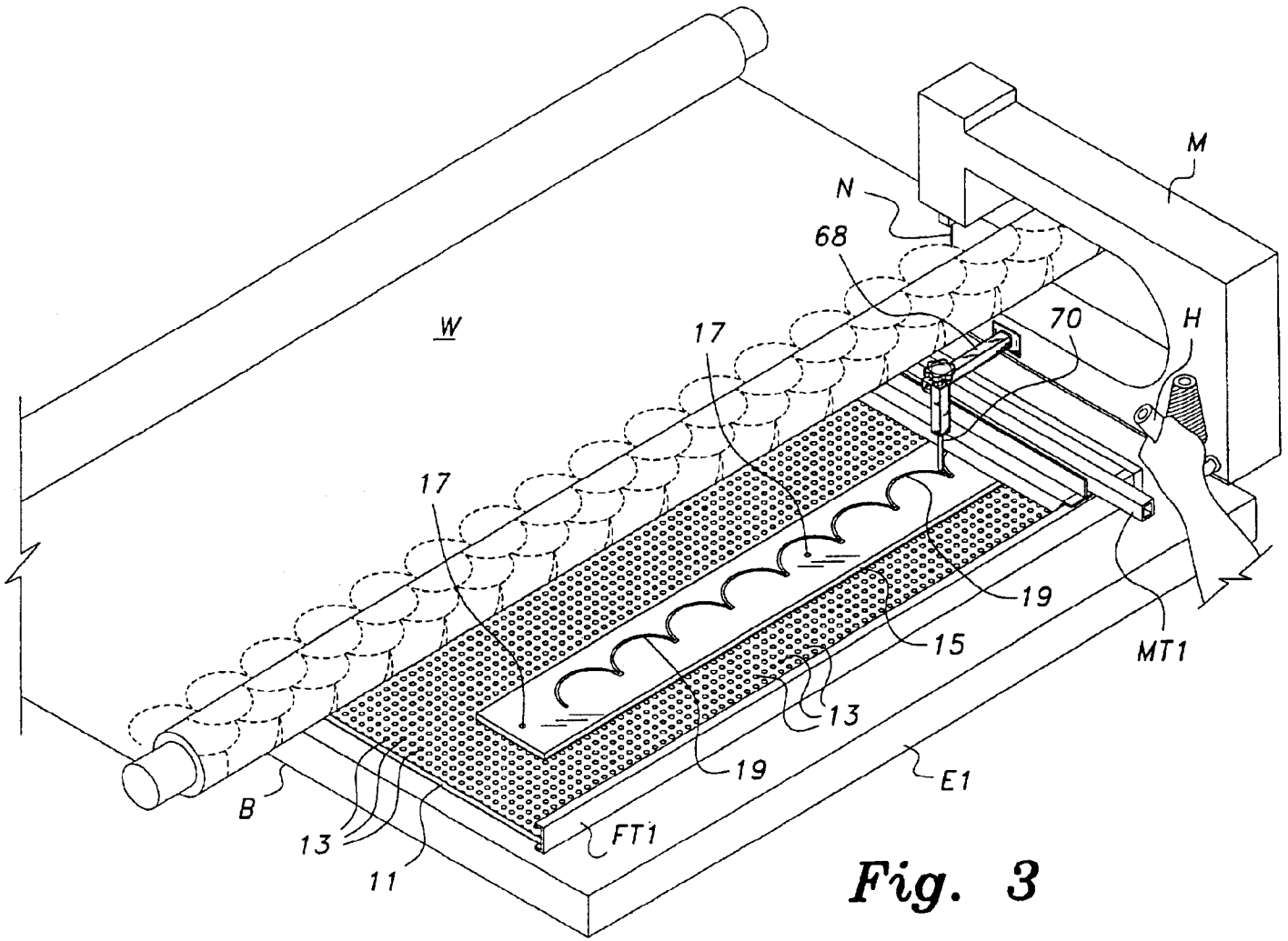
FIG. 3 is an environmental perspective view of another embodiment of the present guide, showing a large template attachment sheet and an adjustably positionable template thereon.

FIG. 3 provides an environmental perspective view of an alternative embodiment of the present invention, wherein a relatively large base plate 11 is immovably (but removably) affixed to the table bed B, using conventional clamps, tape, pins or pegs, etc, as desired. Alternatively, the base plate 11 may be immovably affixed to the crossmember 12, which in turn is immovably affixed between the two fixed tracks FT1 and FT2 of the machine bed B, as described further above. The base plate 11 preferably comprises a relatively large, rectangular sheet of material having a size sufficient to cover a substantial majority of, or at least a large portion of, the surface of the machine table or bed B. The base plate 11 includes a matrix of relatively small template attachment passages or holes 13 therein or therethrough, permitting the attachment of other articles thereto by means of one or more pegs which may be removably installed in selected ones of the base plate holes 13. The template attachment holes or passages 13 are preferably provided in an evenly spaced, uniform array to cover essentially the entire surface of the base plate 11. The base plate may be formed of a sheet of pegboard, or other similar material as desired.

A stitching pattern template 15 is immovably (but removably) affixed atop the base plate 11, by means of a series of pegs or pins 17 which pass through or depend from the template 15. The template attachment pins 17 are located in the template 15, so as to engage correspondingly spaced holes or passages 13 in the underlying base plate 11. The multitude of holes 13 in the base plate 11, allow the template 15 to be repositioned as desired in a large, but finite, number of positions on the base plate in order to repeat overlying stitching patterns as desired.

The template 15 includes at least one stylus pin guide channel 19 formed therein. The guide channel 19 may comprise a slot which passes completely through the thickness of the template 15, or a groove which extends only partially through the thickness of the template 15 material. In the case of closed pattern shapes, a groove having a depth less than the thickness of the template 15 is obviously used, in order to maintain the integrity of the closed pattern configuration. While a series of semicircular arcs or scallops is shown as the template pattern or channel 19 of the template 15 of FIG. 3, it will be recognized that any of a multitude of different template patterns, e.g., zigzag or sawtooth, various geometric shapes, etc., may be provided as desired.

The base plate 11 and its template 15 are used by affixing the base plate 11 immovably to the table bed B or crossmember 12, and affixing the template 15 immovably to the base plate 11 by means of the attachment pegs or pins 17. The vertically positionable stylus 70 (shown in detail in FIG. 10) is then lowered to engage the template pattern channel 19, and thereby guide the machine M in making a corresponding stitching pattern. The operation is generally similar to that used with the stitching guide components illustrated in FIGS. 1 and 2 of the drawings and described further below, but is somewhat simplified in that there is no need for the extension arm 24, template attachment plate 32, stepping disc 42, and circle guide template 58 when using the base plate 11 and guide template 15 of FIG. 3.

Figure 4:
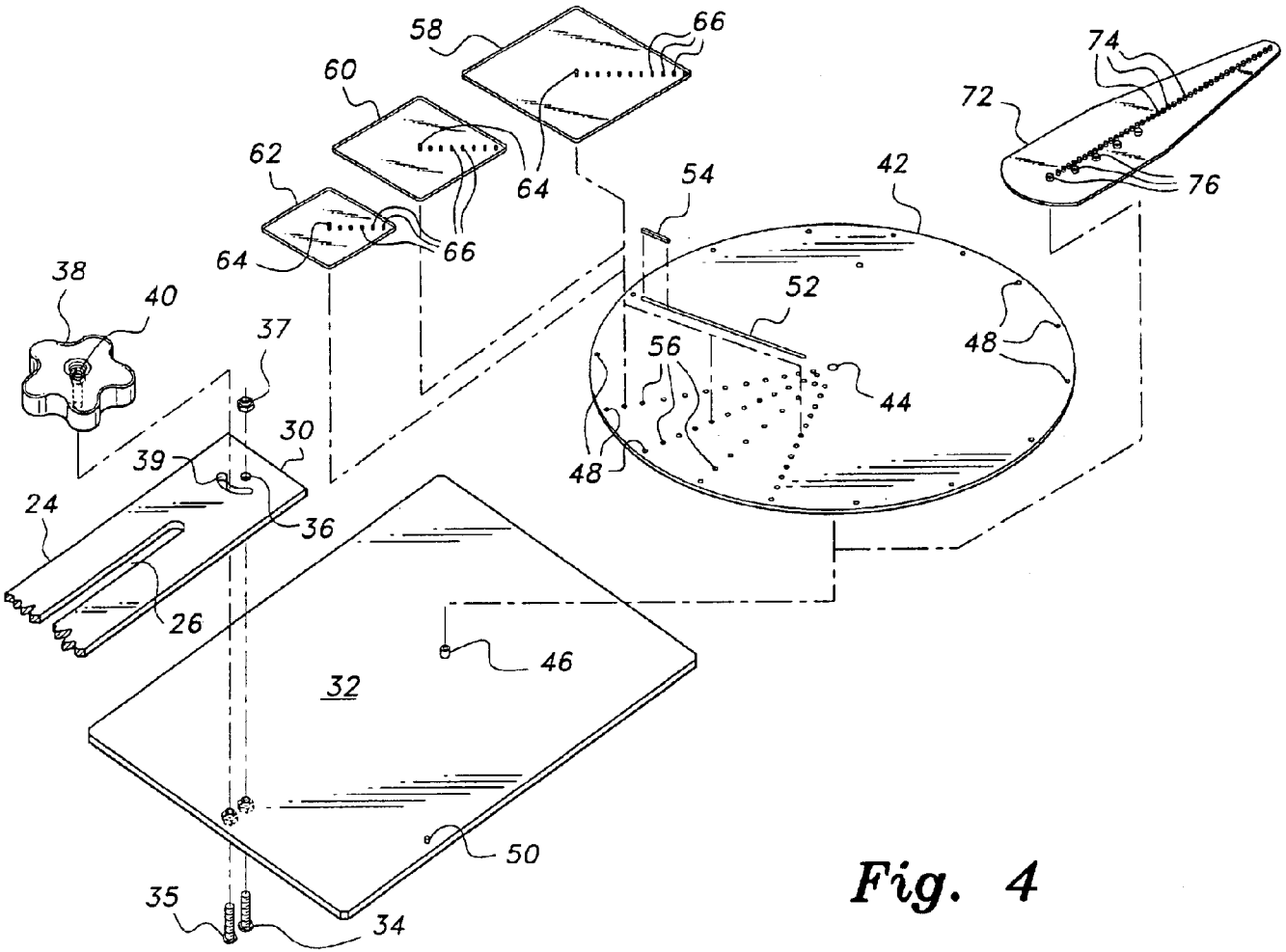
FIG. 4 is an exploded perspective view of a series of templates which may be interchangeably secured to the distal or guide end of the slotted arm, for forming various stitching patterns as desired.

FIG. 4 illustrates details of the attachment of the template attachment plate 32 to the template attachment end 30 of the extension arm 24, and also shows a series of different stitching or guide templates which may be used with the present invention. The template attachment plate 32 includes first and second threaded fasteners 34 and 35 (e.g., studs, bolts, etc.) which extend upwardly through the plate 32, preferably near one edge thereof. While these fasteners 34 and 35 are shown separated from the plate 32 in FIG. 4, it will be understood that they are normally provided in an assembled state.

A first attachment passage 36 is provided through the template attachment end 30 of the extension arm 24, to pass over the first template attachment plate fastener 34. This first attachment passage 36 is relatively small, having a diameter closely matching that of the first fastener 34, with the first or pivot fastener 34 acting as a pivot axis relative to the extension arm 24 and template attachment plate 32. A nut 37 is used to secure the pivot fastener 34 in place, with conventional washers (not shown) being used as desired.

The end 30 of the extension arm 24 also includes a second attachment passage 39 therethrough, comprising an arcuate slot having a center point concentric with the center of the first passage 36. The second or adjustment fastener 35 passes through this arcuate slot 39, and serves as a positionally adjustable stop to limit the movement of the template attachment plate 32 relative to the end 30 of the extension arm 24. A lock knob 38 or other suitable mating fastener having a threaded insert 40 is secured to the externally threaded second fastener 35 extending from the plate 32, to lock the position of the plate 32 relative to the extension arm 24. One or more conventional washers (not shown) may be placed between the knob 38 and the underlying surface of the extension arm 24, to raise the knob 38 sufficiently to clear the adjacent nut 37. This arrangement permits the template attachment plate 32 to be adjustably positioned angularly through a range of positions relative to its pivot point defined by the first attachment plate pivot fastener 34 and its connection to the extension arm 24, and allows the relative positions of the template attachment plate 32 and extension arm 24 to be locked immovably together by tightening the knob 38 as desired.

The template attachment plate 32 is used to removably and adjustably secure one or more stitching or guide templates indirectly to the template attachment end 30 of the extension arm 24. The primary template used with the present invention is a relatively large diameter stepping disc 42. The disc 42 includes a central hole or passage 44, which fits removably over a mating, upwardly extending template centering pin 46 on the template attachment plate 32. The stepping disc 42 also has a series of peripheral indexing holes or passages 48, which selectively align with an indexing pin 50 located near one edge of the template attachment plate 32. The indexing holes 48 of the disc 42 and corresponding indexing pin 50 of the attachment plate 32, secure the template or disc 42 immovably to the plate 32 to provide a foundation for other attachments.

The disc 42 includes a stylus guide slot 52 for straight stitching lines. A spline or stop 54 of suitable length may be installed in the slot, to limit the stitching line as desired. The disc 42 also includes a series of circle guide locating pin passages 56 therein, radially spaced from the central hole 44. These holes 56 are spaced from the central hole 44 by predetermined distances, thereby allowing a user of the device to position a selected circle guide at any practicable distance from the center 44 of the stepping disc 42, as desired.

At least one, and preferably a plurality, of larger through smaller circle guides or templates, e.g. guides 58, 60, and 62, is provided, as shown in FIG. 3. Each guide or template 58 through 62 includes a central locating pin 64 depending therefrom, for selective insertion into one of the guide attachment pin passages 56 of the stepping disc 42. Each circle guide 58 through 62 also has a series of spaced apart stylus pin receptacles or holes 66 therein, whereby the motion of the stylus, and thus the sewing machine head M, may be confined to a circular path as defined by the selected stylus pin receptacle 66 of the circle guide 58 through 62 being used. The circle guides, and other templates, are preferably formed of transparent or translucent material, so the user may see the underlying component(s) for alignment and assembly therewith.

The general operation of the above described components may be seen by returning to FIGS. 1 and 2 of the drawings. The present invention may be used to form a wide variety of different stitching patterns in a workpiece W (quilt, etc.) as desired, depending upon the specific guide selected and the arrangement of the components. In FIGS. 1 and 2, the apparatus is set up to form a series of overlapping circular patterns P in the workpiece W, generally as indicated by the broken line stitching patterns P in the workpiece W in FIG. 1.

The initial position of the sewing machine M is set by positioning the needle N over or through the workpiece W material, as desired. The sewing machine M includes a stylus attachment arm 68 extending therefrom, with a vertically adjustable (but horizontally fixed, relative to the machine M) stylus 70 depending from the end of the stylus arm 68. The stylus 70 is lifted while the remainder of the assembly is adjusted as desired. The various clamps and locking devices, i.e. the crossmember lock 22, extension arm lock 28, and/or the template attachment plate knob 38, are loosened, allowing the various components to be adjusted to position the selected stylus pin hole 66 (FIG. 3) of the selected circle guide, e.g. guide 58, directly beneath the stylus pin.

In the example shown in FIGS. 1 and 2, where a series of smaller circles is formed in an overlapping circular pattern having a larger radius, the stepping disc 42 and a circle guide template, e.g., guide 58, are used. The central pin 64 (FIG. 3) of the guide 58 is installed in the selected guide pin passage 56 (FIG. 4) of the stepping disc 42, to define the larger diameter circle upon which the smaller circles will be formed. The apparatus is then adjusted to position the stylus 70 in the selected stylus pin hole 66 (FIG. 4) of the guide 58, to define the diameters of the smaller circles of the pattern.

At this point, the various locking devices 22, 28, and 38 are locked down to secure the relative positions of all components except the circle guide 58, which is free to rotate about its central locating pin on the larger stepping disc 42. The sewing machine M may then be operated by actuating the stitching or sewing mechanism and guiding the machine M by means of the handles H conventionally provided with such quilting machines. As the stylus tip is engaged with the selected stylus pin passage 66 (FIG. 4) of the circle guide 58, the sewing machine M and its needle N are restricted to a circular path defined by the radius of the selected stylus pin hole or passage 66 of the selected circle guide template 58. The machine M is manipulated to complete the defined circular path, thus completing a circular stitching pattern.

When the first small circle is completed as described above, the stepping disc 42 is reindexed by positioning the next selected indexing hole 48 (FIG. 4) over the indexing pin 50 (FIG. 3) of the template attachment plate 32. The stylus 70 remains engaged with the previously selected stylus pin passage of the circle guide template 58, and the machine M and its needle N are repositioned correspondingly. A second circle is stitched corresponding to the reindexed position of the circle guide 58, and the process is continued as desired.

FIG. 4 and the remaining drawing Figs. illustrate further accessories, embodiments, and mechanical details of the present guide apparatus 10. In many instances, it may be desirable to form a larger circle, or at least an arc having a larger radius, than is possible with any of the circle guide templates 58 through 62. One well known pattern used in quilting is the "Baptist fan." This pattern comprises a series of overlapping semicircular arcs of relatively large diameter.

Accordingly, a Baptist fan guide template 72 may also be provided with the present apparatus, as shown in FIG. 4. This guide 72 comprises a thin, elongate sheet preferably formed of transparent or translucent material, as in the case of the stepping disc 42 and other guides 58 through 62 described further above. The Baptist fan guide 72 has a series of stylus pin engaging passages 74 formed therein, providing a wide range of incrementally increasing radii for forming circles or semicircular arcs. The Baptist fan guide 72 also includes a series of attachment plate pin engaging holes or passages 76 formed therein. The sequential use of these holes or passages, allows a series of overlapping circles or semicircular arcs (i.e., the "Baptist fan" pattern) to be formed, by selectively moving the fan guide 72 to a different pin engaging passage 76 at the completion of each arcuate stitch.

Figure 5:
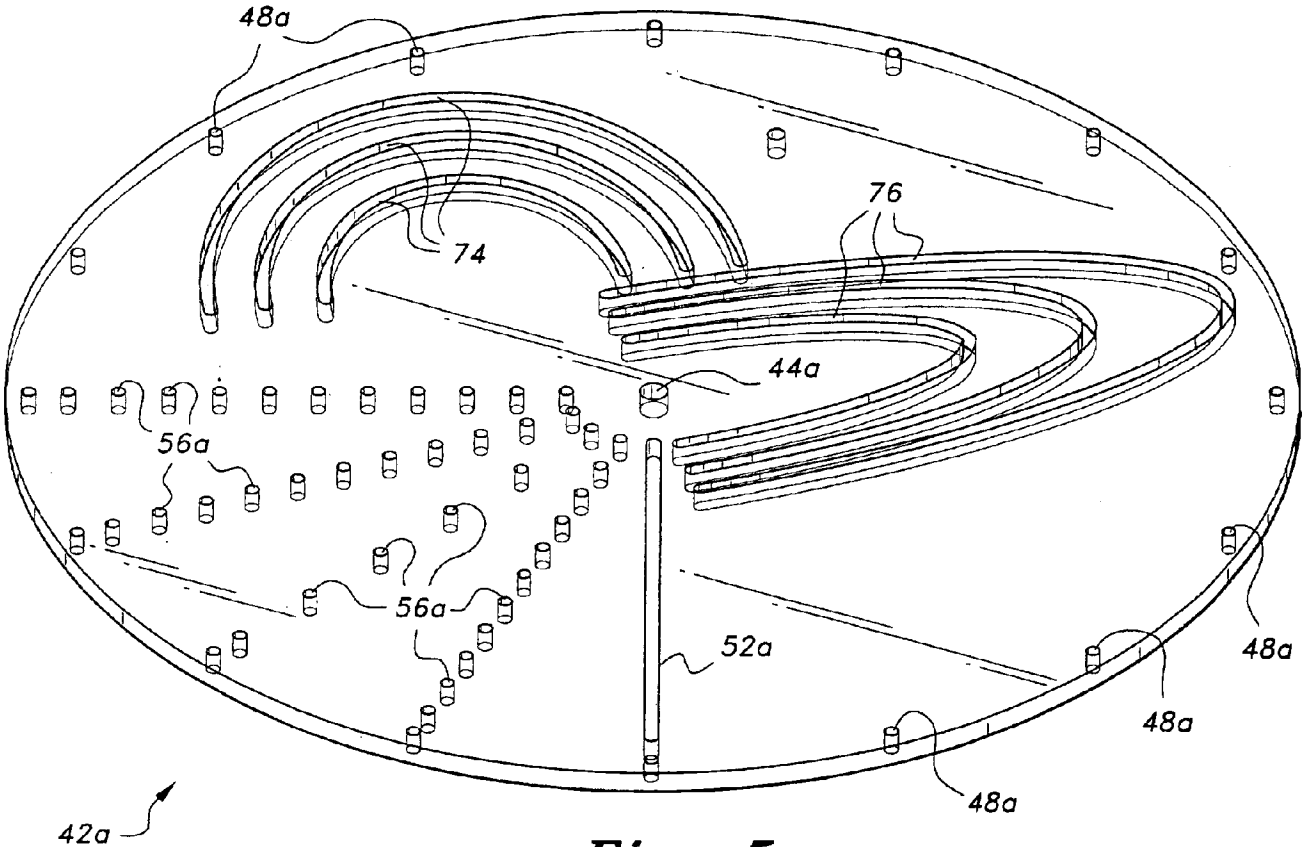
FIG. 5 is a detailed perspective view of a template for forming various stitching patterns as desired, in which the guide slots or passages extend completely through the template.

FIG. 5 provides an illustration of an alternative stepping disc, designated as stepping disc 42*a*. The disc 42*a* of FIG. 4 includes many of the same features as the stepping disc 42 of FIGS. 1, 2, and 4, i.e. a central passage 44*a* for assembly to the centering pin 46 of the attachment plate 32, a series of peripheral indexing holes or passages 48*a*, a linear guide slot 52*a*, and a series of radially disposed guide attachment pin holes or passages 56*a*. Accordingly, the alternative stepping disc 42*a* may be used to accomplish many of the same functions as the stepping disc 42 of FIGS. 1, 2, and 4.

However, the stepping disc 42*a* of FIG. 5 also includes a series of arcuate slots 74 and a series of elliptical slots 76 of varying dimensions. These slots 74 and 76 serve to engage the stylus 70, and thus guide the sewing machine M along a corresponding path to form a stitching pattern corresponding to the shape of the selected arc 74 or elliptical segment 76. The arcs and elliptical segments 74 and 76 extend completely through the thickness of the stepping disc 42*a*, and thus do not comprise a closed geometric shape or pattern. However, a closed stitching pattern is easily formed using the stepping disc 42*a* of FIG. 5, by reindexing the disc 42*a* by 180 degrees to reverse the orientation of the segments after the first segment has been stitched, and completing the pattern.

Figure 6:
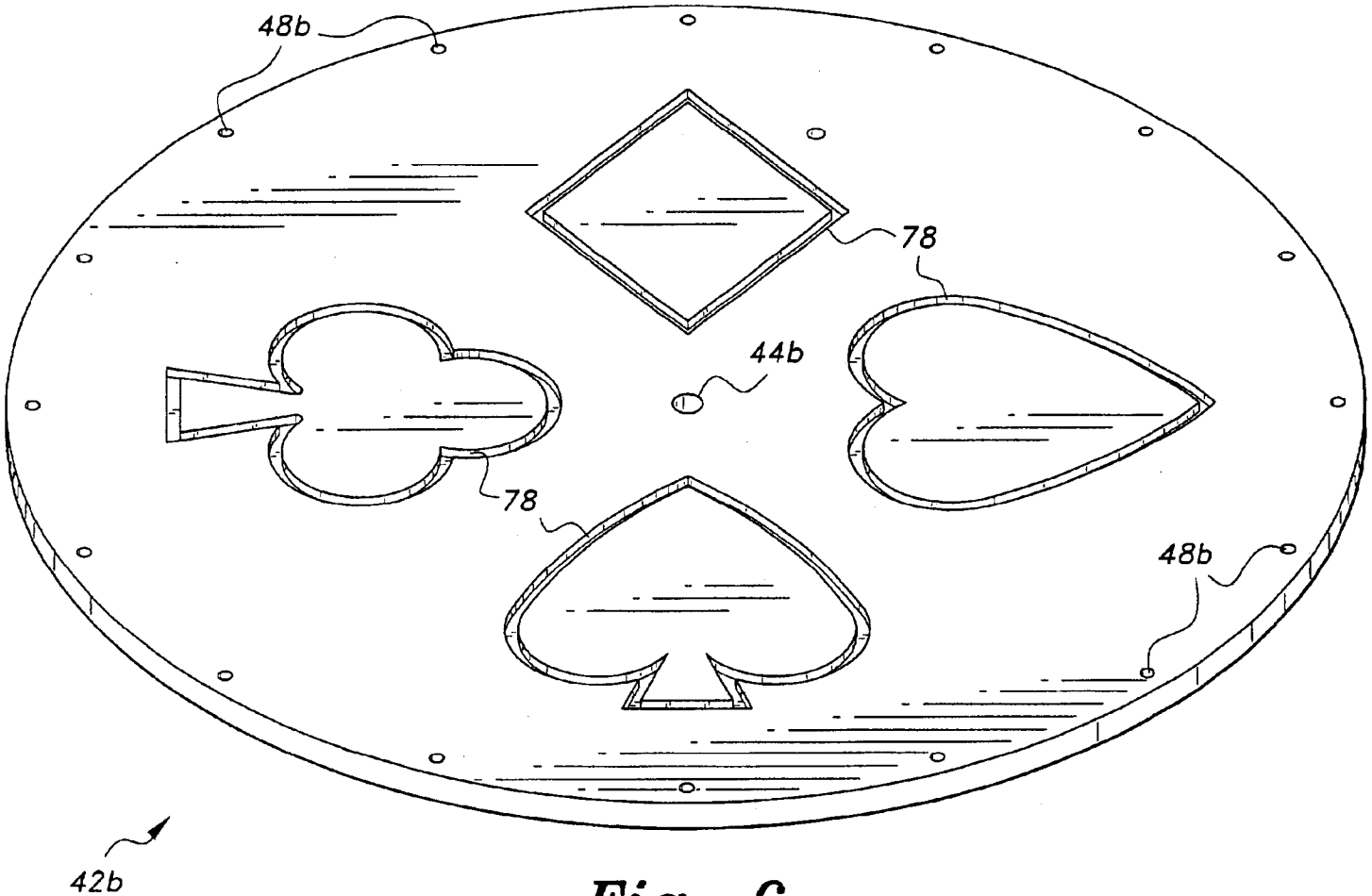
FIG. 6 is a detailed perspective view of an alternative template including a series of closed pattern shapes, with the guide slots extending only partially through the template.

FIG. 6 illustrates another stepping disc, designated as stepping disc 42*b*. The disc 42*b* includes a central hole 44*b* for attachment to the template attachment plate centering pin 46 and a series of peripheral indexing holes or passages 48*b* for radially indexing the position of the disc 42*b* relative to the attachment plate 32. These holes or passages 44*b* and 48*b* extend completely through the disc 44*b* to receive the underlying pins, as in the case of the corresponding holes or passages of the stepping discs 44 and 44*a* discussed above.

However, the stepping disc 44*b* of FIG. 6 also includes a series of closed patterns 78 formed thereon, e.g., the spade, heart, diamond, and club card suit patterns shown. Obviously, it is not possible to form a closed pattern in a sheet of material by means of a slot which passes completely through the sheet; the central portion of the pattern would separate from the remainder of the sheet in such cases. Accordingly, the closed patterns 78 of the stepping disc 42*b* of FIG. 6 are formed by a series of grooves which extend only partially through the thickness of the disc 42*b*, with a continuous and unbroken thickness of material remaining beneath the depth of the grooves. It will be seen that any practicable closed pattern(s) may be formed using this method, with different patterns provided on opposite sides of the disc if so desired.

Figure 8:
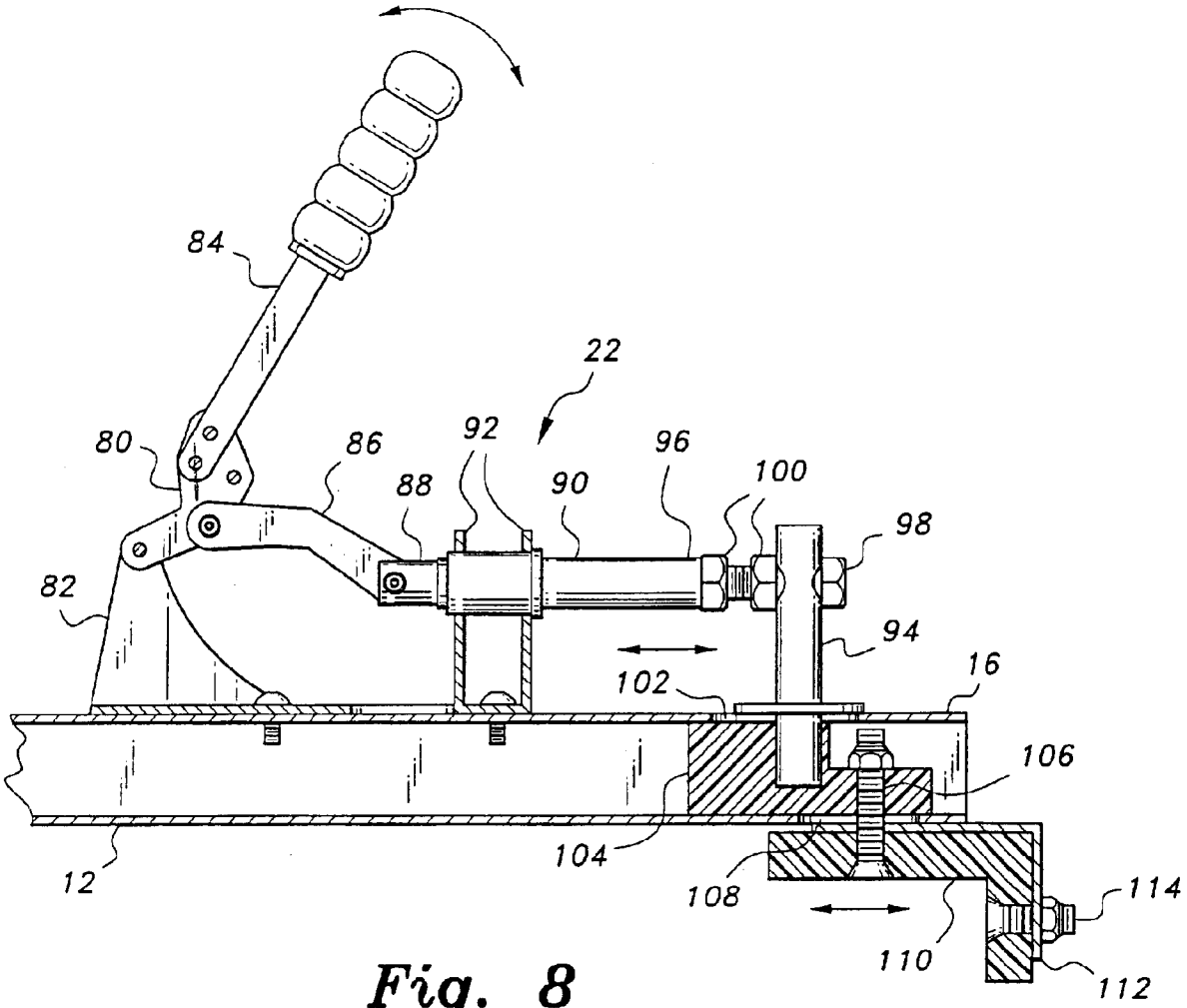
FIG. 8 is a detailed side elevation view in partial section of a second embodiment of the mechanism for locking the crossmember between the two fixed tracks of the machine table.

FIGS. 7 and 8 illustrate details of a pair of alternate embodiments of the over center position lock mechanism 22 used to lock the position of the crossmember 12 immovably between the opposite fixed tracks FT1 and FT2 (or other track configuration) of the quilting machine bed or table. In the compression locking embodiment of FIG. 7, an over center lever 80 is pivotally attached to a fixed fulcrum 82 mounted atop the crossmember 12. A handle 84 extends from the lever 80. The lever drives an intermediate link 86, which in turn connects to the handle attachment end 88 of a generally horizontal pushrod 90 which passes through a stabilizing fixture or bracket 92.

A generally vertical actuator arm 94 depends from and is adjustably attached to the actuator end 96 of the pushrod 90 by a threaded adjustment bolt 98 extending from the actuator end 96 of the pushrod 90, with a pair of jam nuts 100 adjusting the length of the bolt 98 and securing the actuator arm 94 against the head of the bolt 98. The actuator arm 94 passes through an elongate slot 102 in the upper surface of the hollow crossmember 12 and engages an internal slide block 104 within the end 16 of the crossmember 12. The internal slide block 104 attaches to the external movable compression block or shoe 20 by a bolt 106 which passes through a slot or passage 108 in the underside of the end 16 of the crossmember 12.

The crossmember 12 is first adjusted to allow some free play for easy movement when unlocked, by adjusting the nuts 100 securing the adjustment bolt 98 to the pushrod 90 and the actuator arm 94 to the bolt 98. The crossmember 12 may then be locked in place between the two fixed tracks FT1 and FT2 (FIG. 2) by pivoting the handle 84 toward the crossmember end 16 to extend the pushrod 90, actuator arm 94, internal block 104, and compression block 20 outwardly relative to the crossmember 12, i.e., to the right in FIG. 7. This extends the span of the two compression blocks 18 and 20 between the two fixed tracks FT1 and FT2, wedging the crossmember immovably between the two tracks. Release of the crossmember 12 for positional adjustment is easily accomplished by reversing the above operation, i.e. moving the handle 84 away from the cross-member end 16, to retract the compression block 20 slightly.

The alternative embodiment crossmember 12 of FIG. 8 includes nearly all of the same components as the crossmember 12 of FIG. 7, with the exception of the external compression block 20. Rather than having such a compression member to wedge the crossmember 12 between a pair of fixed tracks, the crossmember 12 of FIG. 8 is equipped with an L-shaped gripping shoe at each end thereof, to grip the exterior of the tracks on machine tables or beds so equipped.

FIG. 8 illustrates only the crossmember end 16 having the movable gripping shoe 110 extending therefrom, but it will be understood that the opposite end of the crossmember 12 of FIG. 8 is equipped with a stationary shoe having a mirror image configuration to the movable shoe 110 illustrated in FIG. 8. The movable shoe 110 (and its opposite stationary counterpart) may be provided with a reinforcement 112 formed of a sturdy metal angle, if so desired. An additional attachment bolt and nut assembly 114 may be provided to secure the reinforcement 112 to the depending leg of the shoe 110 and its opposite fixed counterpart, if so desired.

The locking mechanism for the crossmember 12 illustrated in FIG. 8 operates essentially opposite the mechanism illustrated in FIG. 7. The mechanism linkage is initially adjusted for proper fit, using the adjustment bolt 98 with its two adjustment nuts 100. The handle 84 of the FIG. 8 mechanism is then moved away from the crossmember end 16, to cause the linear actuator 90 to act as a pull rod. This draws the actuator arm 94 toward the handle 84, thereby pulling the internal slide block 104 and its attached external gripping shoe 110 toward the opposite end of the crossbar to capture the fixed track structure of the machine table or bed, therebetween.

Figure 9:
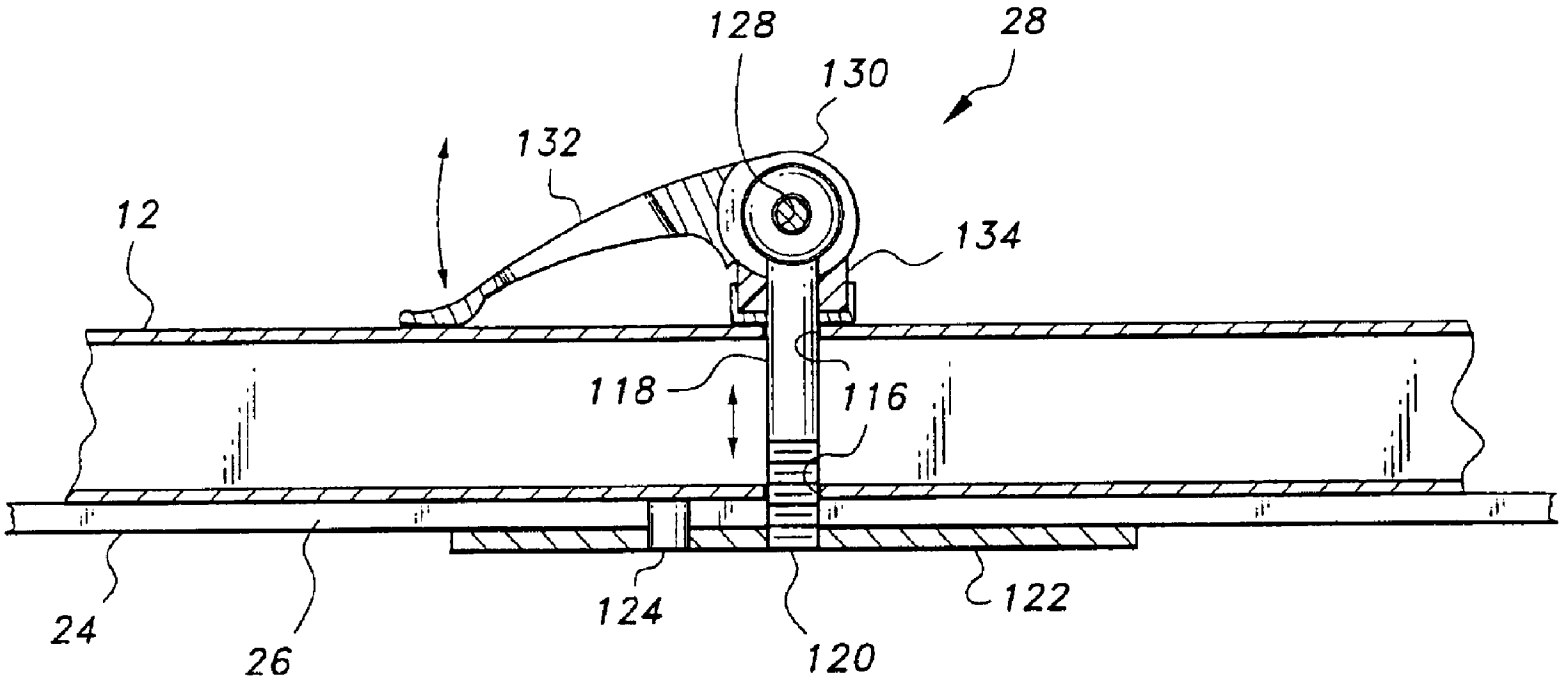
FIG. 9 is a detailed side elevation view in section of the mechanism used for locking the position of the slotted arm relative to the crossmember.

FIG. 9 of the drawings provides a detailed elevation view in section of the mechanism 28 used to lock the extension arm 24 immovably to the crossmember 12. The hollow crossmember 12 includes a locking bolt passage 116 formed through both surfaces thereof, with a locking bolt 118 extending therethrough. The threaded grip end 120 of the locking bolt 118 extends through the slot 26 of the underlying extension arm 24 to engage an extension arm grip plate 122, which captures the extension arm 24 between the grip plate 122 and the lower surface of the crossmember 12. The grip plate 122 includes an upwardly extending indexing pin 124, which engages the slot 26 of the extension arm 24 to prevent rotation of the grip plate 122 relative to the extension arm 24 as the lock bolt 118 is turned to tighten or loosen the assembly.

The upper or handle end 126 of the lock bolt 118 has an eye 128 formed therethrough which serves to attach the bolt 118 to an eccentric cam 130, with a lever handle 132 extending from the cam 130. The cam 130 rides in a concave compression fitting 134, which is captured on the lock bolt 118 between the cam 130 and the underlying upper surface of the crossmember 12 to transfer forces from the cam 130 to the upper surface of the crossmember 12.

The mechanism is initially adjusted by lifting the handle 132 to release any grip pressure from the cam 130, and threading the lock bolt 118 into the underlying grip plate 122 until a proper, slightly loose assembly is achieved. As the lever handle 132 is lowered toward the lock position illustrated in FIG. 8, the increasing thickness of the cam 130 as it is rotated bears downwardly in the compression fitting 134, thereby lifting the locking bolt 118 upwardly to pull the grip plate 122 tightly against the extension arm 24 to lock the arm 24 securely against the crossmember 12. Release of the locking pressure for positional adjustment of the extension arm 24 is accomplished by lifting the lever handle 132 to release the grip pressure.

Figure 10:
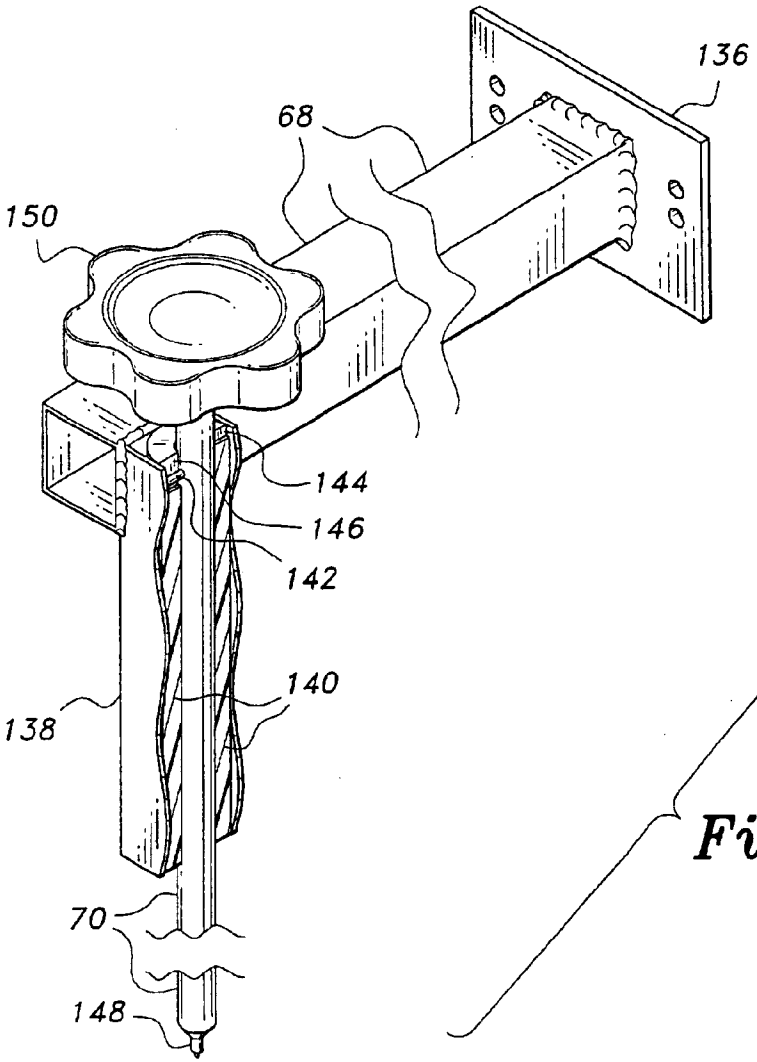
FIG. 10 is a detailed perspective view of the stylus or guide pin and its sewing machine attachment arm.

FIG. 10 of the drawings provides a detailed perspective view in partial section of the stylus assembly of the present invention, which is affixed to the sewing machine M (FIGS. 1 through 3). The stylus assembly attaches to the machine M by means of an attachment plate or bracket 136, from which the generally horizontal stylus attachment arm 68 extends. The distal end of the extension arm 68 has a hollow stylus holder tube 138 rigidly attached thereto and depending therefrom. A bearing sleeve 140 formed of a low friction plastic or other suitable material, is installed within the stylus holder tube 138.

The stylus 70 is slidably installed within the bearing sleeve 140, and is free to slide upwardly and downwardly within the sleeve 140 to the limits defined by a lateral retaining pin 142 disposed above the upper end of the bearing sleeve 140. The bearing sleeve 140 may include at least one relatively shallow, radially disposed retaining slot 144 therein, to engage the stylus retaining pin 142 and hold the stylus shaft 70 in a raised or disengaged position. This retaining slot 144 also serves to resist rotation of the stylus shaft 70 within the bearing sleeve 140, by holding the retaining pin 142.

The bearing 140 also includes at least one relatively deep slot 146 therein, allowing the stylus 70 to drop downwardly through the sleeve 140. This allows the small diameter stylus tip pin 148 at the lower end of the stylus shaft 70 to drop downwardly sufficiently far to engage a selected one of the stylus pin holes 66 of one of the circle guide templates 58 through 62 (FIG. 4), one of the straight or arcuate slots 52, 74, or 76 of one of the stepping discs 42 or 42*a* (FIGS. 4 and 5), or one of the closed patterns 78 of the closed pattern stepping disc 42*b* (FIG. 6), etc., depending upon the specific pattern selected. A stylus knob 150 may be provided at the upper end of the stylus 70, for manipulating and positioning the stylus shaft 70 and its depending tip pin 148 as desired.

The stylus shaft 70 is initially placed in its raised position, by lifting the stylus knob 150 and rotating the stylus shaft 70 in its bearing sleeve 140 to position the retaining pin 142 over the shallower pin retaining slot 144. This holds the stylus tip pin 148 clear of the workpiece W and any templates or guides being positioned on the workpiece W. Once the sewing machine M is positioned precisely as desired, with its needle N at the appropriate initial position to begin work, the templates and guides selected are positioned with the specific stylus pin hole 66, slot 52, 74, 76, etc. beneath the stylus tip pin 148. The stylus knob 150 is then lifted slightly and rotated to allow the retaining pin 142 to drop downwardly into the deeper bearing slot 146, thus allowing the stylus tip pin 148 to drop into the selected pin hole, slot, etc. of the selected template or guide.

Precise alignment of the sewing machine needle N with a predetermined point on the workpiece W, while simultaneously attempting to align the selected template or guide with the stylus tip pin 148, may be difficult, depending upon the degree of accuracy desired or required and the intricacy of the selected pattern. Accordingly, the present invention also provides a needle locating indicator 152, illustrated in the plan view of FIG. 11.

Figure 11:
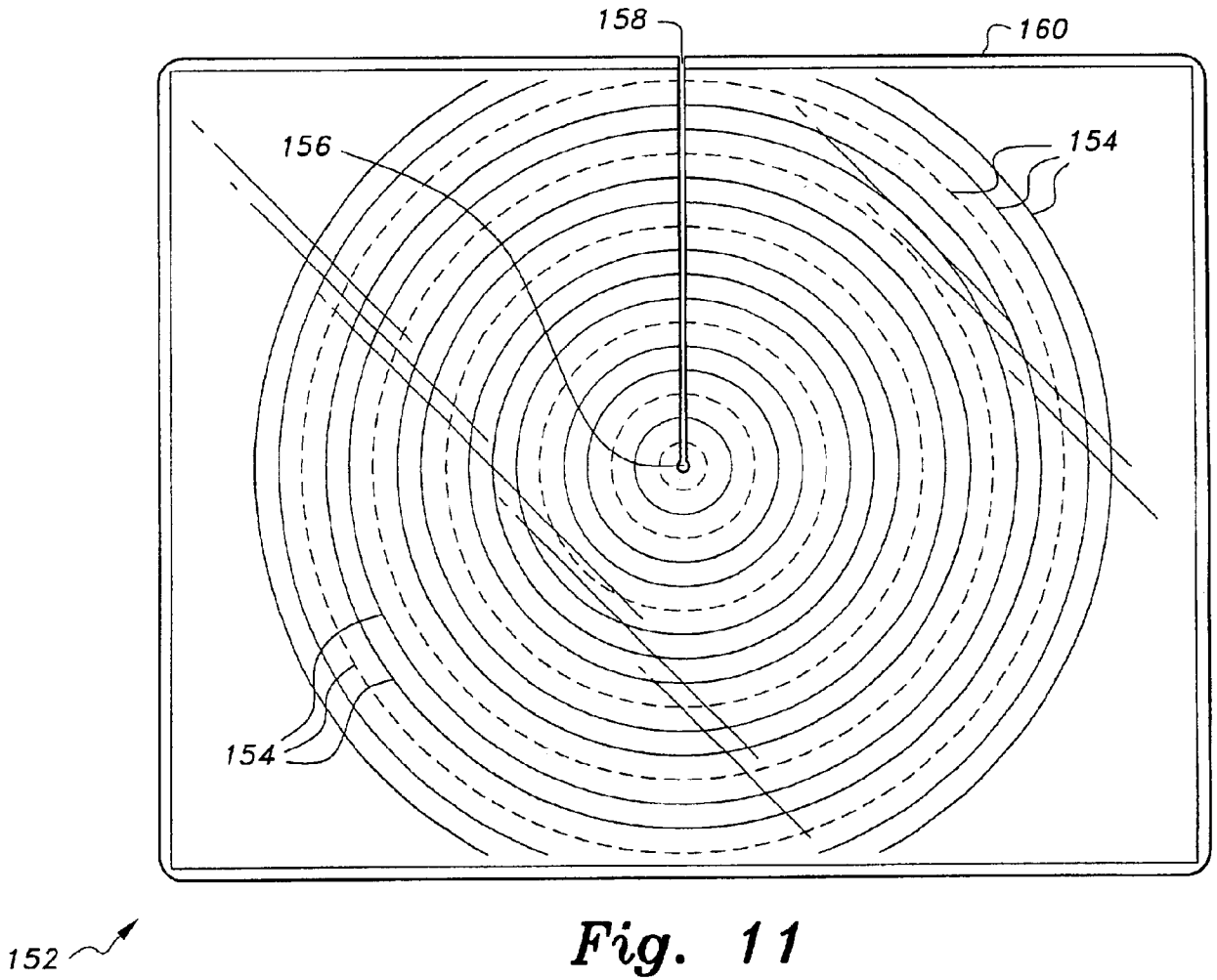
FIG. 11 is a top plan view of a centering guide or pattern which may be used with the present invention to center the sewing machine needle precisely in the workpiece as desired.

The needle locating indicator 152 is formed of a thin, flat sheet of transparent or translucent material so the user may see any stitching pattern(s), marking(s), etc. previously applied to the workpiece, with which the stitching to be applied must be aligned. The indicator 152 includes a series of thin, circular (or perhaps other regular geometric shape) concentric alignment rings or lines 154 thereon, which may alternate between heavy and light, unbroken and broken lines as shown in FIG. 11, or may be formed using any pattern of broken, unbroken, dashed, dotted, or other line configurations as desired. The use of alternating lines of different types and weights facilitates the alignment of one side of a particular ring, e.g. a broken line ring, with the opposite side of the same ring, when aligning the indicator 152 over a pattern.

The indicator 152 has a central needle insertion passage 156 formed therein, concentric with the series of alignment rings 154. A needle removal slot 158 extends from the needle insertion passage 152, radially outwardly to the periphery 160 of the device 152. This allows the indicator 152 to be placed upon the workpiece W as desired, the sewing machine needle N to be inserted through the central needle insertion passage 156, and the indicator 152 to be withdrawn from its location around the needle N, by means of the removal slot 158.

The needle locating indicator 152 is used to position the sewing machine needle N precisely in a quilt or other workpiece W which has a previously formed stitching pattern, markings, etc. with which a new pattern must be aligned. The indicator 152 is positioned precisely over the previously formed existing pattern(s) or marking(s) by aligning one of the concentric alignment rings 154 with the pattern(s) or marking(s) referenced. The sewing machine M is then positioned with the needle N directly over the central needle passage 156, and the needle N is lowered into the material of the workpiece W to anchor the machine M relative to the workpiece W. The appropriate templates, guides, etc. may then be positionally adjusted as required, in accordance with the description further above for the crossmember 12, extension arm 24, template attachment plate 32, and stepping disc 42. The center point of the stepping disc, corresponding to the center point of the pattern determined by the needle locating indicator 152, is defined by the centering pin 46 in the template attachment plate 32. This centering pin 46 has a small hole (not shown) in its center, into which the stylus pin 148 may be lowered once the guide assembly has been adjustably positioned to align the centering pin 46 and its hole directly beneath the stylus pin 148.

The above described pattern alignment method assures that any new stitching pattern formed, will be in registry with the previously formed pattern, and/or markings provided on the workpiece W for pattern placement. The operator of the quilting machine and present guide apparatus, need only proceed with the stitching operation by operating the machine M, and guiding the machine M according to the pattern defined by the guide components selected and the capture of the stylus pin therein.

In conclusion, the present guide for forming non-linear patterns using a quilting machine, provides significant advantages over other such devices previously developed. Other purely mechanical stitching guides do not provide the versatility, ease of use, and ability to form the numerous complex stitching patterns provided by the present apparatus. It should also be noted that while various computerized and electronic stitch pattern forming devices have been developed, these are relatively costly and complex in comparison to the present apparatus. The present quilting machine attachment will be greatly appreciated by skilled amateurs as well as those operating home businesses engaged in quilt making, and other operations of similar scale.

It is to be understood that the present invention is not limited to the embodiments described above, but encompasses any and all embodiments within the scope of the following claims.

We claim:

1. A guide for making non-linear stitching patterns on a workpiece using a long arm quilting machine, the quilting machine having a sewing head mounted on a movable set of sewing head tracks, the sewing head tracks disposed orthogonally upon a fixed set of machine bed tracks installed along opposite edges of a machine bed, the guide comprising:

a crossmember having a first end and a second end opposite said first end;

a position lock disposed upon said crossmember adapted for securing said crossmember adjustably between the machine bed tracks;

an extension arm secured to said crossmember, the extension arm being adjustable linearly and radially, the extension arm having a template attachment end;

an extension arm locking mechanism adjustably securing the extension arm to said crossmember;

at least one template adjustably and removably secured to the template attachment end of the extension arm, the at least one template having at least one stylus pin receptacle formed therein; and a vertically positionable stylus adapted for being immovably affixed horizontally to the machine head, the stylus selectively engaging the at least one stylus pin receptacle of the at least one template.

2. The guide according to claim 1, wherein said at least one template has at least one circle guide locating pin receptacle defined therein, the guide further including:

at least one supplemental circle guide having a central locating pin depending therefrom and inserted through the pin receptacle defined in said template so that the circle guide pivots on said template, the circle guide having at least one stylus pin receptacle defined therein.

3. The guide according to claim 1, wherein said template further includes at least one stylus pin guide selected from the group consisting of at least one stylus pin guide slot, at least one circle guide pin passage, a plurality of peripherally disposed indexing passages formed therethrough, and at least one groove extending partially therethrough and defining at least one closed pattern thereon.

4. The guide according to claim 1, further including:

a template attachment plate adjustably secured to said template attachment end of said extension arm, said at least one template being adjustably and removably secured to said template attachment plate.

5. The guide according to claim 4, further including:

a threaded pivot fastener and a threaded adjustment fastener disposed upwardly from said template attachment plate, the template attachment end of said extension arm having a pivot fastener passage and an arcuate adjustment fastener passage therethrough;

a nut securing said pivot fastener in place through the pivot fastener passage of the template attachment end of said extension arm, pivotally securing said template attachment plate to said extension arm;

an attachment knob having a threaded insert therein adjustably engaging said threaded adjustment fastener, adjustably locking said template attachment plate to said extension arm; and a template centering pin and a template indexing pin each extending upwardly from said template attachment plate.

6. The guide according to claim 1, wherein said lock of said crossmember comprises:

a generally horizontally disposed pushrod having a handle end and an actuator end opposite said handle end;

a pivotally mounted, over center handle connected to said handle end of said pushrod;

an actuator arm depending from said actuator end of said pushrod; and a compression block extending adjustably from said first end of said crossmember, communicating with said actuator arm.

7. The guide according to claim 1, wherein said position lock further comprises:

a generally horizontally disposed pull rod having a handle end and an actuator end opposite said handle end;

a pivotally mounted, over center handle connected to said handle end of said pull rod;

an actuator arm depending from said actuator end of said pull rod; and a gripping shoe extending adjustably from said first end of said crossmember, communicating with said actuator arm.

8. The guide according to claim 1, wherein said crossmember has a locking bolt passage formed therethrough, said extension arm locking mechanism of said crossmember comprises:

a locking bolt having a handle end and a grip end opposite said handle end, installed through said locking bolt passage;

an extension arm grip plate secured to said grip end of said locking bolt, capturing said extension arm between said grip plate and said crossmember; and a cam lever handle adjustably secured to said handle end of said locking bolt.

9. The guide according to claim 1, further including:

a needle locating indicator formed of a translucent sheet of material and having a periphery;

said needle locating indicator further including a centrally disposed needle insertion passage therethrough, and a needle removal slot extending from said needle insertion passage to said periphery of said sheet; and a series of concentric alignment rings disposed upon said needle locating indicator, about said needle insertion passage.

10. A long arm quilting machine and guide for use therewith for making non-linear stitching patterns in a workpiece, comprising in combination:

a quilting machine bed having at least a first edge and a second edge opposite said first edge;

a first and a second machine bed track immovably affixed respectively to each said edge of said bed;

a first and a second sewing head track movably disposed orthogonally across each said machine bed track;

a sewing head affixed atop said first and said second sewing head track;

a crossmember having a first end and a second end opposite said first end, disposed between said first and said second machine bed track;

a position lock disposed upon said crossmember, securing said crossmember adjustably between said first and said second machine bed track;

an extension arm linearly and radially adjustably secured to said crossmember;

an extension arm locking mechanism adjustably securing said extension arm to said crossmember;

a template attachment end disposed on said extension arm;

at least one template adjustably and removably secured to said template attachment end of said extension arm;

said at least one template having at least one stylus pin receptacle formed therein; and a vertically positionable stylus immovably affixed horizontally to said machine head, selectively engaging said at least one stylus pin receptacle of said at least one template.

11. The quilting machine and guide combination according to claim 10, further including:

at least one supplemental circle guide having a central locating pin depending therefrom and at least one stylus pin receptacle therein; and said at least one template further including at least one circle guide locating pin receptacle therein, for pivotally securing said locating pin of said at least one supplemental circle guide thereto.

12. The quilting machine and guide combination according to claim 10, wherein said template further includes at least one stylus pin guide means selected from the group consisting of at least one stylus pin guide slot, at least one circle guide pin passage, a plurality of peripherally disposed indexing passages formed therethrough, and at least one groove extending partially therethrough and defining at least one closed pattern thereon.

13. The quilting machine and guide combination according to claim 10, further including:

a template attachment plate adjustably secured to said template attachment end of said extension arm; and said at least one template adjustably and removably secured to said template attachment plate.

14. The quilting machine and guide combination according to claim 10, further including:

a threaded pivot fastener and a threaded adjustment fastener disposed upwardly from said template attachment plate;

said template attachment end of said extension arm further including a pivot fastener passage and an arcuate adjustment fastener passage therethrough;

a nut securing said pivot fastener in place through said pivot fastener passage of said template attachment end of said extension arm, pivotally securing said template attachment plate to said extension arm;

an attachment knob having a threaded insert therein adjustably engaging said threaded adjustment fastener, adjustably locking said template attachment plate to said extension arm; and a template centering pin and a template indexing pin each extending upwardly from said template attachment plate.

15. The quilting machine and guide combination according to claim 10, wherein said lock of said crossmember comprises:

a generally horizontally disposed pushrod having a handle attachment end and an actuator end opposite said handle attachment end;

a pivotally mounted, over center handle connected to said handle attachment end of said pushrod;

an actuator arm depending from said actuator end of said pushrod; and a compression block extending adjustably from said first end of said crossmember, communicating with said actuator arm.

16. The quilting machine and guide combination according to claim 10, wherein said lock of said crossmember comprises:

a generally horizontally disposed pull rod having a handle attachment end and an actuator end opposite said handle attachment end;

a pivotally mounted, over center handle connected to said handle attachment end of said pull rod;

an actuator arm depending from said actuator end of said pushrod; and a gripping shoe extending adjustably from said first end of said crossmember, communicating with said actuator arm.

17. The quilting machine and guide combination according to claim 10, wherein said extension arm locking mechanism of said crossmember comprises:

said crossmember having a locking bolt passage formed therethrough;

a locking bolt having a handle end and a grip end opposite said handle end, installed through said locking bolt passage;

an extension arm grip plate secured to said grip end of said locking bolt, capturing said extension arm between said grip plate and said crossmember; and a cam lever handle adjustably secured to said handle end of said locking bolt.

18. The quilting machine and guide combination according to claim 10, further including:

a needle locating indicator formed of a translucent sheet of material and having a periphery;

said needle locating indicator further including a centrally disposed needle insertion passage therethrough, and a needle removal slot extending from said needle insertion passage to said periphery of said sheet; and a series of concentric alignment rings disposed upon said needle locating indicator, about said needle insertion passage.

19. A guide for making non-linear stitching patterns on a workpiece using a long arm quilting machine, the quilting machine having a sewing head mounted on a movable set of sewing head tracks, the sewing head tracks disposed orthogonally upon a fixed set of machine bed tracks installed along opposite edges of a machine bed, the guide comprising:

a removable base plate immovably affixed to and covering a substantial portion of the machine bed;

said base plate further including a matrix of template attachment passages therein;

at least one template adjustably and removably secured to said base plate by means of said template attachment passages;

said at least one template having at least one continuous stylus pin channel formed therein; and a vertically positionable stylus immovably affixed horizontally to the machine head, selectively engaging said at least one stylus pin channel of said at least one template.

20. The guide according to claim 19, wherein said at least one continuous stylus pin channel is selected from the group consisting of at least one guide slot extending completely through said template and at least one guide groove extending partially through said template.

* * * * *